US011982135B2

(12) United States Patent
Simpson

(10) Patent No.: US 11,982,135 B2
(45) Date of Patent: May 14, 2024

(54) DOWNHOLE APPARATUS FOR REDUCING ROTATIONAL AND LINEAR FRICTION BETWEEN A DOWNHOLE TOOL AND/OR A DOWNHOLE TOOL STRING COMPRISING THE DOWNHOLE TOOL AND A WALL OF A WELLBORE

(71) Applicant: Neil Andrew Abercrombie Simpson, Aberdeen (GB)

(72) Inventor: Neil Andrew Abercrombie Simpson, Aberdeen (GB)

(73) Assignee: PARADIGM DRILLING SERVICES LTD., Aberdeenshire (GB)

( * ) Notice: Subject to any disclaimer, the term of this patent is extended or adjusted under 35 U.S.C. 154(b) by 298 days.

(21) Appl. No.: 17/440,783

(22) PCT Filed: Mar. 19, 2020

(86) PCT No.: PCT/EP2020/057685
§ 371 (c)(1),
(2) Date: Sep. 19, 2021

(87) PCT Pub. No.: WO2020/188057
PCT Pub. Date: Sep. 24, 2020

(65) Prior Publication Data

US 2022/0162918 A1 May 26, 2022

(30) Foreign Application Priority Data

Mar. 19, 2019 (GB) ..... 1903692

(51) Int. Cl.
*E21B 17/10* (2006.01)

(52) U.S. Cl.
CPC ..... *E21B 17/1042* (2013.01); *E21B 17/1014* (2013.01)

(58) Field of Classification Search
CPC ..... E21B 17/1064; E21B 17/1078; E21B 17/1014; E21B 17/1042
See application file for complete search history.

(56) References Cited

U.S. PATENT DOCUMENTS 2,657,956 A * 11/1953 Hall, Sr. ..... E21B 17/1042 175/325.5
2002/0023749 A1* 2/2002 Kirk ..... E21B 17/22 166/241.1

(Continued)

FOREIGN PATENT DOCUMENTS

WO 1998037302 A1 8/1998
WO 1999025949 A2 5/1999

(Continued)

OTHER PUBLICATIONS

Oxford Dictionary Facilitate—https://www.oxfordlearnersdictionaries.com/us/definition/english/facilitate?q=facilitate (Year: 2023).*

*Primary Examiner* — David Carroll
(74) *Attorney, Agent, or Firm* — William H. Honaker; Dickinson Wright PLLC

(57) ABSTRACT

A downhole apparatus (10; 10') for reducing rotational and linear friction between a downhole tool (100; 100') and/or a downhole tool string and the wall of a wellbore (B) includes an annular body portion (12; 12') configured for location on a mandrel (102; 102') of the downhole tool (102; 102') and one or more rib portions (16; 16') extending radially from the annular body portion (12; 12'), and configured to engage a wall of the wellbore (B), the annular body portion (12; 12') and the one or more rib portions (16; 16') are integrally formed. The annular body portion (12; 12') is elastically reconfigurable between a first configuration in which the annular body portion (12; 12') defines a first inner diameter and a second configuration in which the annular body portion (12; 12') defines a second inner diameter configu- (Continued)

ration, the second inner diameter being larger than the first inner diameter. The annular body portion (12; 12') is elastically or plastically reconfigurable between the second configuration and a third configuration in which the annular body portion (12; 12') defines a third inner diameter, the third inner diameter being smaller than the second inner diameter.

27 Claims, 9 Drawing Sheets

(56) References Cited

U.S. PATENT DOCUMENTS

| | | | | |
|---|---|---|---|---|
| 2003/0164236 | A1* | 9/2003 | Thornton | E21B 17/1042 166/278 |
| 2014/0158432 | A1* | 6/2014 | Simpson | E21B 17/1057 175/73 |
| 2015/0013997 | A1* | 1/2015 | Simpson | E21B 17/1064 166/241.6 |
| 2018/0080304 | A1 | 3/2018 | Cortez et al. | |

FOREIGN PATENT DOCUMENTS

| | | | |
|---|---|---|---|
| WO | 2002002904 | A1 | 1/2002 |
| WO | 2012143722 | A2 | 10/2012 |
| WO | 2013121231 | A2 | 8/2013 |
| WO | 2015026243 | A2 | 2/2015 |

* cited by examiner

DOWNHOLE APPARATUS FOR REDUCING ROTATIONAL AND LINEAR FRICTION BETWEEN A DOWNHOLE TOOL AND/OR A DOWNHOLE TOOL STRING COMPRISING THE DOWNHOLE TOOL AND A WALL OF A WELLBORE

CROSS-REFERENCE TO RELATED APPLICATIONS

The present application claims priority to PCT International Patent Application Serial No. PCT/EP2020/057685 filed Mar. 19, 2020 entitled "Downhole Apparatus," which claims priority to GB Patent Application Serial No. 1903692.0 filed Mar. 19, 2019, the content of which are incorporated herein by reference in their entireties.

FIELD

This relates to a downhole apparatus for reducing rotational and linear friction between a downhole tool and/or a downhole tool string and the wall of a well borehole; to a downhole tool and/or tool string comprising the apparatus and to associated methods of use and construction.

BACKGROUND OF THE INVENTION

Within the oil and gas industry, in order to access hydrocarbons from a formation, a well borehole ("wellbore") is drilled from surface. The wellbore is then lined with sections of bore-lining metal tubulars, known as casing, and production infrastructure installed to facilitate the ingress of hydrocarbons into the wellbore and transport them to surface.

The development of directional drilling techniques has facilitated the creation of high angle and horizontal wellbores (referred to below collectively as horizontal wellbores) which deviate from vertical and thus permit the wellbore to follow the hydrocarbon bearing formation to a greater extent. Amongst other things, horizontal wellbores beneficially facilitate increased production rates due to the greater length of the wellbore which is exposed to the reservoir.

In view of the benefits of horizontal wellbores, there is a continuing desire to extend the length or "reach" of horizontal wellbores. However, the operation of extended reach development wellbores (known in the industry as ERD wells) nevertheless poses a number of significant challenges.

For example, where a large proportion of the wellbore is drilled at very high borehole angle and in many cases is drilled horizontally for considerable distances, this means that a major portion of the drilling tubulars forming the drill string lie on the low side of the wellbore. As the drilling tubulars must be rotated in order to transmit mechanical power to the drilling assembly and to facilitate transmission of weight to the drill bit, unwanted rotational friction is generated between the rotating drilling tubulars and the wellbore wall. The effect is such that rotational friction generated by the weight of the tubulars forming the drill string in rubbing contact with the low side of the wellbore becomes a limiting factor in the length of horizontal wellbores that can be achieved in any given size of wellbore. This limit is reached as the torque required to rotate the drill string from surface approaches the torsional capability of the drill string connections (that is the threaded connections between the sections of drill pipe).

In addition, in order to push the rotating drilling tubulars along the high angle or horizontal sections of the borehole, the weight of the drilling tubulars in the vertical section of the hole must first be translated through the build (i.e. cased) section of the wellbore. This places very high side loads on the casing at this point in the wellbore, which in turn leads to high frictional losses and accelerated casing wear.

In the case of re-entry wells, which may have tortuous well paths to avoid other wells on multiple well platforms, high side loads are also experienced by the rotating drilling tubulars, which again lead to high frictional losses and/or potential casing wear.

Rotational friction generated by the drilling tubulars rotating on the low side of the wellbore also leads to increased vibration in the drill string due to pipe precession. In addition to causing further loss of mechanical power transmission to the drilling assembly and the drill bit, the increased risk of developing excessive drill string vibration is a major cause of reduced drill bit life and damage to rotary steerable systems.

Linear sliding friction of the contact points between the drill string and the low side of the wellbore is another factor leading to difficulty in applying controlled weight to the drill bit and in achieving horizontal reach of ERD wells.

All of the factors mentioned above have a detrimental effect on the efficiency of the drilling process and the extent of the horizontal reach that can be achieved for any given ERD well.

In many areas around the World, horizontal wellbores "step out" several kilometres laterally from the surface location of the drilling rig being used to drill the wellbore. Wytch Farm in England is one such example of a wellbore where the horizontal step out typically ranges from 3,000 metres to 5,000 metres, with the record ERD well having a step out in excess of 11,000 metres. However, the majority of ERD wells have benefited from the fact that the major portion of the wellbore, the tangent section, has been drilled at 60 to 70 degrees to the horizontal. This assists the bulk of the drilling tubulars to slide down the wellbore with only the last section of the wellbore approaching the true horizontal of 90 degrees to vertical. However, this approach to the design of ERD wells is only applicable where there is sufficient depth between the surface location and the hydrocarbon reservoir to be tapped. In many cases around the World, this is not the case and many reservoirs are relatively shallow, resulting in longer truly horizontal sections of borehole to be drilled.

The main factor that contributes to the limitation of horizontal reach is the cumulative torque generated by the drilling tubulars in rubbing contact with the wellbore. This can be calculated from the vertical cumulative weight of the tubulars lying on the low side of the wellbore in the high angle and horizontal section multiplied by the frictional coefficient, normally taken at between 0.2 and 0.3 for cased and open borehole respectively, in conjunction with the radius of the rotating tubulars making contact with the wellbore.

For example, 10,000 ft. of drilling tubular in open borehole with an average vertical weight component of 19 lbs per linear ft. acting at a contact radius of 3.39 ins with a friction coefficient of 0.3 would generate a cumulative torque of 10,000×19×(3.39 divided by 12)×0.3=16,102 ft/lbf. At an average drilling rotational speed of 150 RPM this would result in the loss of approximately 460 horse power in frictional losses.

This frictional loss will increase as a function of borehole length and will eventually reach a point where the mechanical power input at surface may be totally consumed before the drill string reaches the bottom of the wellbore. Well before this point is reached, however, torsional friction will have reached a level where the threaded connections in the jointed drilling tubulars can no longer safely support the drilling process. Continued drilling beyond this point would risk the potential of twist off or torsional failure of the drilling tubulars.

In addition, linear friction or drag also creates a problem and the potential to effectively limit drilling long horizontal sections of wellbore. This is especially the case in shallow reservoirs where the rate of angle build from vertical to horizontal can be quite severe.

It can therefore be seen that the friction affects in high angle and horizontal borehole, both rotational and linear, are major factors limiting the efficient drilling of ERD wells.

There are a number of downhole tools currently in use in the oil industry which set out to address these friction losses and reduce the friction factor of the rubbing and sliding contact of rotating tubulars lying on the low side of the wellbore. These tools generally include a non-rotating bearing sleeve clamped onto the body of the drilling tubulars or mounted on a sub-based tool installed between the threaded connections of the drilling tubulars.

Nevertheless, there are a number of limitations associated with conventional tools.

SUMMARY

Aspects of the present disclosure relate to a downhole apparatus for reducing rotational and linear friction between a downhole tool and/or a downhole tool string and the wall of a well borehole; to a downhole tool and/or tool string comprising the apparatus and to associated methods of use and construction.

According to a first aspect, there is provided a downhole apparatus for reducing rotational and linear friction between a downhole tool and/or a downhole tool string and the wall of a wellbore, comprising:

- an annular body portion configured for location on a mandrel of the downhole tool;
- one or more rib portions extending radially from the annular body portion, and configured to engage a wall of the wellbore,
- wherein the annular body portion and the one or more rib portions are integrally formed,
- wherein the annular body portion is elastically reconfigurable between a first configuration in which the annular body portion defines a first inner diameter and a second configuration in which the annular body portion defines a second inner diameter configuration, the second inner diameter being larger than the first inner diameter,
- and wherein the annular body portion is elastically or plastically reconfigurable between the second configuration and a third configuration in which the annular body portion defines a third inner diameter, the third inner diameter being smaller than the second inner diameter.

The annular body portion and the one or more rib portions may be formed from an elastomeric material. The elastomeric material may take the form of a rubber material, such as silicone rubber or Hydrogenated nitrile butadiene rubber (HNBR).

Alternatively, the annular body portion and the one or more ribs may be formed from a thermoplastic material, such as Polyether ether ketone (PEEK) or Polytetrafluoroethylene (PTFE).

Alternatively, the annular body portion and the one or more ribs may be formed from a fibre reinforced polymer plastic or other non-metallic material.

In use, the downhole apparatus may take the form of a bearing sleeve configured to reduce rotational and linear friction between the downhole tool and the wall of the wellbore.

The downhole tool may form part of a downhole tool string, the downhole tool functioning to reduce friction between the downhole tool string and the wall of the wellbore during ingress into and/or egress out of the wellbore. In particular, but not exclusively, the downhole tool string may take the form of a drill string used to drill the wellbore, but may alternatively take the form of a completion string, work string or the like. It will be understood that in the context of the present disclosure the term wellbore is used to mean either or both of a cased section of the wellbore or open hole section of the wellbore.

The apparatus provides a number of benefits over conventional tools and equipment.

For example, in contrast to conventional tools the present apparatus comprises an annular body portion, that is a single piece, unitary or substantially unitary construction which surrounds the mandrel of the downhole tool. This obviates the requirement for split sleeve designs which add to complexity, cost and increased risk of failure downhole, and which require service breaks in order to install. The provision of an annular body portion also obviates the requirement to provide associated clamps and threaded components to hold the split sleeves together.

The provision of an annular body portion and one or more ribs integrally formed from a non-metallic material, in particular but not exclusively an elastomeric material such as HNBR, a thermoplastic material, such as PEEK or PTFE or a fibre reinforced polymer plastic, facilitates drilling out where required; in contrast to conventional tools which require metallic components which cannot be easily drilled using conventional drill bits and so risk leaving "junk" in the wellbore.

Moreover, the relatively low coefficient of friction of the material used to form the integrally formed annular body portion and rib portions reduces both rotational and linear friction, amongst other things improving drilling efficiency, reducing casing wear and increasing the potential length of high angle or horizontal ERD wellbores. The relatively low density of the integrally formed annular body portion and rib portions.

As the density of the material used to form the integrally formed annular body portion and rib portions is low compared to steel, any material loss from the apparatus, should it occur, can be readily circulated out of the wellbore.

As described above, the apparatus comprises an annular body portion, wherein the annular body portion is elastically reconfigurable between a first configuration in which the annular body portion defines a first inner diameter and a second configuration in which the annular body portion defines a second inner diameter configuration, the second inner diameter being larger than the first inner diameter, and wherein the annular body portion is elastically or plastically reconfigurable between the second configuration and a third configuration in which the annular body portion defines a third inner diameter, the third inner diameter being smaller than the second inner diameter.

In use, elastic reconfiguration of the apparatus from the first configuration to the second configuration facilitates location of the apparatus around, and along, the mandrel of the downhole tool while reconfiguration of the apparatus from the second configuration to the third configuration facilitates location of the apparatus on the mandrel of the downhole tool.

The body portion may be tubular or generally tubular in construction. The body portion may define an axial throughbore. The axial throughbore may be circular. In use, the axial throughbore may be configured, e.g. sized and/or shaped, to facilitate location of the body portion on and around the mandrel of the downhole tool. The body portion may have an outer diameter matched to the outer body diameters of the mandrel of the downhole tool such that when located on the mandrel the areas are flush or substantially flush with the mandrel.

As described above, the apparatus comprises one or more rib portions extending radially from the annular body portion.

The apparatus may comprise a plurality of rib portions.

In use, the one or more rib portions form blades which offset the downhole tool from the wellbore and facilitate fluid bypass around the outside of the annular body portion in the annulus between the apparatus and the wellbore.

The one or more rib portions may be parallel or substantially parallel with a longitudinal axis of the apparatus. The one or more rib portions may have a curved profile, whereby a central part of the rib portion extends radially further than end parts of the rib portion.

However, it will be understood that the rib portions may have other forms. For example, the one or more rib portions may alternatively extend at least partially circumferentially around the annular body portion, in particular but not exclusively in a spiral configuration or the like.

Beneficially, extending at least partially circumferentially around the annular body portion provides greater circumferential contact area with the wellbore.

One or more of the rib portions may alternatively have sloped end parts and a central part which is parallel or substantially parallel with the longitudinal axis of the apparatus.

Areas of the annular body portion disposed between the rib portions may be of constant or substantially constant wall thickness.

Beneficially, as well as functioning to facilitate fluid bypass around the outside of the apparatus, the areas may function as stretch zones facilitating the reconfiguration of the apparatus between the first, second and third configurations.

As described above, the downhole apparatus may take the form of a bearing sleeve configured to reduce rotational and linear friction between the downhole tool and the wall of the wellbore.

The apparatus may form, or form part of, a bearing arrangement. The bearing arrangement may comprise a rotational bearing and/or one or more thrust bearing. The bearing arrangement may be between the apparatus and the downhole tool, in particular the mandrel of the downhole tool. The bearing arrangement formed by the apparatus may comprise a fluid lubricated bearing, for example but not exclusively a drilling fluid (e.g. mud) lubricated bearing.

An inner circumferential surface of the body portion may define a radial bearing surface. In use, a radial bearing may be formed between the radial bearing surface and the mandrel, in particular a bearing journal formed by a recess on the mandrel.

At least one end wall of the body portion may define a thrust bearing surface. In particular, each end wall of the body portion may define a thrust bearing surface. In use, a thrust bearing may be formed between the thrust bearing surfaces of the apparatus and the mandrel, in particular a side wall of the recess on the mandrel.

The apparatus may comprise a fluid lubrication arrangement for lubricating at least one of the radial bearing and thrust bearings.

The fluid lubrication arrangement may comprise one or more flute. The one or more flute may be formed in the inner circumferential surface of the annular body portion. The fluid lubrication arrangement may comprise a plurality of flutes. The flutes may be circumferentially arranged and/or spaced.

The fluid lubrication arrangement may comprise one or more slot. The one or more slot may be formed in the end walls of the annular body portion. The, or each, slot may communicate with the one or more flute, so as to provide means for entry and exit of fluid into the flute. The fluid lubrication arrangement may comprise a plurality of slots.

The slots may be circumferentially arranged and/or spaced.

In use, the fluid lubrication arrangement may facilitate passage of fluid, e.g. drilling fluid, to the radial and/or thrust bearing surfaces.

Beneficially, the fluid may be biased through the fluid lubrication arrangement due to the annular pressure drop across the apparatus.

The fluid lubrication arrangement may extend axially. For example, the one or more flutes may extend axially, that is parallel or substantially parallel to the longitudinal axis of the apparatus.

However, it will be understood that the fluid lubrication arrangement may take other forms. For example, the one or more flutes may extend axially and at least partially circumferentially. In particular but not exclusively the one or more flutes may define a spiral configuration.

Beneficially, where the one or more flutes extend axially and at least partially circumferentially, e.g. spirally, rotation of the mandrel relative to the apparatus may induce fluid, e.g. drilling fluid, to pass through the fluid lubrication arrangement in a similar manner to an Archimedes screw pump; thereby enhancing lubrication of the radial and/or thrust bearing surfaces.

In use, the fluid lubrication arrangement may receive fluid, in particular but not exclusively drilling fluid, so as to lubricate and cool the radial bearing surface formed by the inner circumferential surface as the mandrel rotates relative to the annular body portion and/or to lubricate and cool the thrust bearing surfaces formed by the end walls.

The apparatus may comprise a reinforcing arrangement.

The reinforcing arrangement may comprise one or more reinforcing members. The one or more reinforcing members may be formed in the annular body portion. For example, the one or more reinforcing members may be moulded as part of the annular body portion. Alternatively or additionally, one or more of the reinforcing members may be applied onto the annular body portion.

The one or more reinforcing members may be elongate. The one or more reinforcing members may take the form of a reinforcing bar. The one or more reinforcing members may be constructed from a resin fibre composite material. However, it will be understood that the one or more reinforcing members may take other suitable forms and may be constructed from other suitable materials.

In use, the one or more reinforcing members may prevent or at least mitigate the possibility of compressive buckling of the apparatus and/or swelling when being pushed and/or pulled through a wellbore restriction.

The reinforcing arrangement may comprise one or more recessed grooves formed in the annular body portion. The one or more recessed grooves may be formed in the annular body portion. For example, the one or more recessed grooves may be moulded as part of the annular body portion. The one or more recessed grooves may extend around or at least partially around the annular body portion. The one or more recessed grooves may be formed at end portions of the annular body portion.

The reinforcing arrangement may comprise one or more locking bands. The one or more locking bands may be configured for location in the respective one or more recessed grooves.

The one or more locking bands may be formed from a composite material. In particular but not exclusively, the locking bands may be formed from aramid fibres such as Kevlar. The one or more locking bands may be bonded in place, for example by a flexible elastomeric silicone, rubber or epoxy based resin or compound.

According to a second aspect, there is provided a downhole tool comprising one or more apparatus according to the first aspect.

The downhole tool may comprise the mandrel.

The mandrel may be generally tubular in construction. The mandrel may have an axial throughbore extending therethrough. The throughbore may be configured to facilitate the flow of drilling fluid and/or tools through the downhole tool. The mandrel may be constructed from thick wall tubing, such as drill pipe or the like. The mandrel may take the form of a sub.

The apparatus may be rotatably mountable on the mandrel so that the mandrel rotates within the apparatus and/or the apparatus rotates around the mandrel.

The downhole tool may form, or form part of, the bearing arrangement. The bearing arrangement may comprise a rotational bearing and/or one or more thrust bearing. The bearing arrangement may be between the apparatus and the downhole tool, in particular the mandrel of the downhole tool. The bearing arrangement formed by the downhole tool may comprise a fluid lubricated bearing, for example but not exclusively a drilling fluid (e.g. mud) lubricated bearing.

The downhole tool may comprise a connection arrangement. The connection arrangement may be formed or otherwise disposed at respective ends of the mandrel. The connection arrangement may facilitate connection of the downhole tool to adjacent components of a downhole tool string. The connection arrangement may comprise a threaded pin connector. The threaded pin connector may be provided at a downhole end of the mandrel. Alternatively or additionally, the threaded pin connector may be provided at an uphole end of the mandrel. The connection arrangement may comprise a threaded box connector. The threaded box connector may be provided at an uphole end of the mandrel. Alternatively or additionally, the threaded box connector may be provided at a downhole end of the mandrel. The threaded pin and box connectors may take the form of API (American Petroleum Institute) connectors. Alternatively, the connection arrangement may take any other suitable form, such as premium connectors or the like.

The mandrel may comprise one or more recess. The one or more recess may be configured to receive the apparatus of the first aspect. A base of the recess may define a recessed bearing journal for the apparatus. One or more end faces of the recess may define thrust bearing surfaces for the apparatus.

One or more upsets may extend radially from the mandrel. The one or more upsets may be formed by the mandrel. Alternatively, the one or more upsets may be coupled to the mandrel. The upset, or each upset where a plurality of upsets are provided, may be disposed at an end of the recess and provide an increased bearing area for the thrust bearing surfaces for a given size of tool and body design. In particular, the downhole tool may comprise two upsets disposed at respective ends of the recess.

It will understood, however, that the mandrel may alternatively define a cylindrical or substantially cylindrical outer surface without upsets. Beneficially, this provides a flush or substantially flush mandrel outer surface, which maximises the flow by area and minimises the effect on ECD (Equivalent Circulating Density) when running large numbers of the downhole tools in the wellbore simultaneously.

The downhole tool may comprise a plurality of the apparatus according to the first aspect. Where the downhole tool comprises a plurality of the apparatus according to the first aspect, the apparatus may be axially spaced along the mandrel.

The apparatus may be mountable on the mandrel so as to define a skew angle relative to a longitudinal axis of the mandrel.

The apparatus may be configured to engage a wall of a borehole or bore-lining tubular.

The apparatus may be mountable on the mandrel so as to define a skew angle relative to a longitudinal axis of the mandrel and configured to engage a wall of a borehole or bore-lining tubular, such that the downhole tool is urged along the wall of the wellbore on rotation of the mandrel.

The provision of a skew angle introduces a longitudinal force component to the interaction between the apparatus and the wall of the wellbore which acts to urge the downhole tool along the wellbore. Accordingly, the apparatus may roll in a helical path rather than a circumferential path around the inside of the wellbore. This rolling helical path may have the effect of transporting the downhole tool and the tool string along the wall of the wellbore.

The apparatus may be mountable on the mandrel so that the apparatus is offset from a central longitudinal axis of the mandrel.

According to a third aspect, there is provided a downhole tool string comprising one or more downhole tool according to the second aspect.

The downhole tool string may comprise a plurality of the downhole tools according to the second aspect.

In use, the downhole tool may function to reduce rotational and linear friction between the downhole tool string and the wall of the wellbore during ingress of the downhole tool string into and/or egress of the downhole tool string out of the wellbore. In particular, but not exclusively, the downhole tool string may take the form of a drill string used to drill the wellbore, but may alternatively take the form of a completion string, work string or the like.

A fourth aspect relates to use of the apparatus of the first aspect to reduce rotational and linear friction between a downhole tool and/or a downhole tool string and the wall of a wellbore.

According to a fifth aspect, there is provided a method of construction of the downhole tool of the second aspect, comprising:

- providing a downhole apparatus according to the first aspect;
- using an expander tool to elastically reconfigure the downhole apparatus from the first configuration in which the annular body portion defines the first inner diameter to the second configuration in which the annular body portion defines the second diameter configuration, the second inner diameter being larger than the first inner diameter;

translating the downhole apparatus along the mandrel of the downhole tool in the second configuration; and elastically or plastically reconfiguring the annular body portion of the apparatus from the second configuration to the third configuration in which the annular body portion defines a third inner diameter, the third inner diameter being smaller than the second inner diameter.

In the third configuration, the annular body portion may define an inner diameter which is the same or substantially the same as in the first configuration. Alternatively, the annular body portion in the third configuration may define an inner diameter which is smaller or larger than in the first configuration.

The step of reconfiguring the apparatus to the third configuration may comprise locating the apparatus in a recess formed in the mandrel of the downhole tool.

As described above, the method comprises using an expander tool to elastically reconfigure the downhole apparatus from the first configuration to the second configuration.

The expander tool may comprise a frusto-conical body portion. The method may comprise forcing the apparatus along the frusto-conical portion of the expander tool.

The expander tool may comprise a cylindrical body portion, that is a portion having a consistent outer diameter. The cylindrical body portion may define an outer diameter equal to, substantially equal to, or larger than the outer diameter of the mandrel of the downhole tool.

The method may comprise coupling the expander tool to the mandrel of the downhole tool.

The method may comprise transferring the apparatus from the expander tool to the mandrel of the downhole tool. In particular, the method may comprise translating the apparatus along from the frusto-conical portion of the expander tool to the cylindrical body portion and translating the apparatus from the cylindrical body portion onto the mandrel of the downhole tool.

The step of elastically reconfiguring the apparatus from the second configuration to the third configuration may comprise allowing the apparatus to automatically return to the first configuration by virtue of elastic contraction.

As described above, the method may comprise plastically reconfiguring the apparatus from the second configuration to the third configuration.

Reconfiguring the apparatus from the second configuration to the third configuration may comprise swaging the apparatus, in particular the annular body portion. Reconfiguring the apparatus from the second configuration to the third configuration may comprise crimping the apparatus, in particular the annular body portion. Reconfiguring the apparatus from the second configuration to the third configuration may comprise crushing the apparatus, in particular the annular body portion.

Alternatively or additionally, reconfiguring the apparatus from the second configuration to the third configuration may comprise applying heat to the apparatus. For example, the method may comprise heating the apparatus above the glass transition temperature ($T_g$) of the material from which the apparatus is formed, facilitating the reconfiguration of the apparatus to the third configuration.

The invention is defined by the appended claims. However, for the purposes of the present disclosure it will be understood that any of the features defined above or described below may be utilised in isolation or in combination. For example, features described above in relation to one of the above aspects or below in relation to the detailed description may be utilised in any other aspect, or together form a new aspect.

BRIEF DESCRIPTION OF THE DRAWINGS

These and other aspects will now be described, by way of example only, with reference to the accompanying drawings, in which.

DETAILED DESCRIPTION OF THE DRAWINGS

Figure 1:
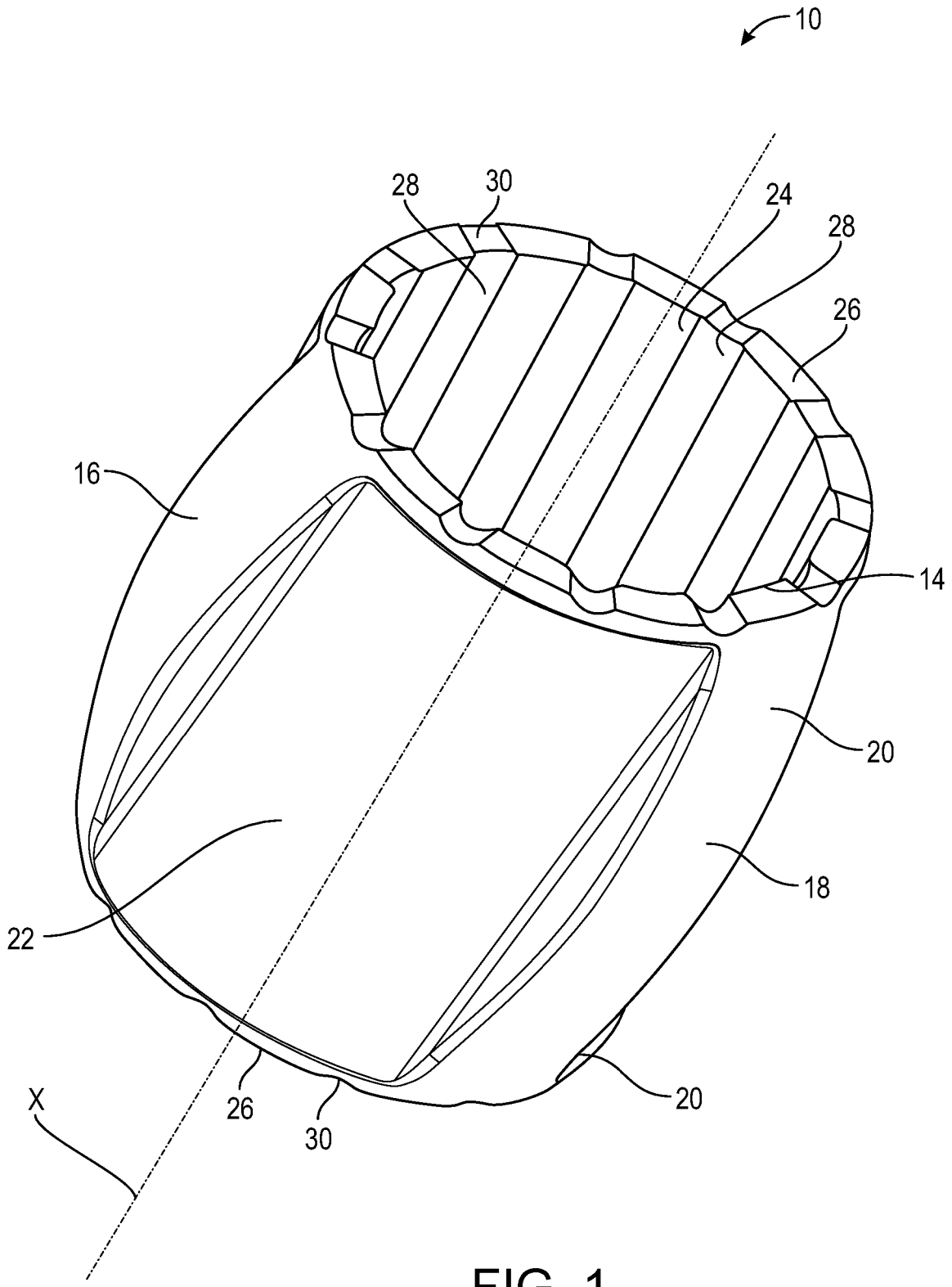
FIG. 1 shows a perspective view of a downhole apparatus for reducing friction between a downhole tool and/or downhole tool string and the wall of a wellbore.

Referring first to FIG. 1 of the accompanying drawings, there is shown a downhole apparatus 10 for reducing friction between a downhole tool 100 and/or downhole tool string and the wall of a well borehole ("wellbore") B.

In use, the downhole apparatus 10 takes the form of a bearing sleeve configured for location on a body or mandrel 102 (shown in FIGS. 2 and 3) of the downhole tool 100, the apparatus 10 functioning to reduce friction between the downhole tool 100 and the wall of the wellbore B. The downhole tool 100 forms part of a downhole tool string, the apparatus 10 and downhole tool 100 functioning to reduce friction between the downhole tool string and the wall of the wellbore B during ingress into and/or egress out of the wellbore B. In particular, but not exclusively, the downhole tool string may take the form of a drill string used to drill the wellbore B, but may alternatively take the form of a completion string, work string or the like. It will be understood that in the context of the present disclosure the term wellbore B is used to mean either or both of a section of the wellbore B lined with bore-lining tubulars ("cased") or an open hole section of the wellbore B.

The apparatus 10 is configured, amongst other things by virtue of its construction and materials, to reduce rotational friction effects between the tool string and the wall of the wellbore B during rotational movement of the apparatus 10, downhole tool 100 and/or downhole tool string are rotating but also reduce linear frictional effects during linear movement of the apparatus 10, downhole tool 100 and/or downhole tool string.

As shown in FIG. 1, the apparatus 10 comprises an annular body portion 12 which is generally tubular in construction, the body portion 12 defining an axial throughbore 14 which facilitates location of the body portion 12 on the mandrel 102 of the downhole tool 100.

As will be described further below, the apparatus 10 is elastically reconfigurable between a first configuration in which the annular body portion 12 defines a first inner diameter and a second configuration in which the annular body portion 12 defines a second inner diameter configuration, the second inner diameter being larger than the first inner diameter. The apparatus 10 is also elastically or plastically reconfigurable between the second configuration and a third configuration in which the annular body portion 12 defines a third inner diameter, the third inner diameter being smaller than the second inner diameter.

In use, elastic reconfiguration of the apparatus 10 from the first configuration to the second configuration facilitates location of the apparatus 10 around, and along, the mandrel 102 of the downhole tool 100 while reconfiguration of the apparatus 10 from the second configuration to the third configuration facilitates location of the apparatus 10 on the mandrel 102 of the downhole tool 100.

A plurality of rib portions 16 extend radially from the annular body portion 12. In use, the rib portions 16 form blades which offset the downhole tool 100 from the wellbore B and facilitate fluid bypass around the outside of the annular body portion 12 in the annulus A between the apparatus 10 and the wellbore B.

In the illustrated apparatus 10, the body portion 12 and the rib portions 16 are integrally formed as a single piece construction.

As shown in FIG. 1, the rib portions 16 are parallel or substantially parallel with the longitudinal axis X of the apparatus 10 and have a curved profile whereby a central part 18 of the rib portions 16 extend radially further than end parts 20 of the rib portions 16.

However, it will be understood that the rib portions 16 may have other forms. For example, whereas in the illustrated apparatus 1 the rib portions 16 are parallel or substantially parallel with the longitudinal axis X of the apparatus 10, the rib portions 16 may alternatively extend at least partially circumferentially around the annular body portion 12, in particular but not exclusively in a spiral configuration or the like. Beneficially, extending at least partially circumferentially around the annular body portion 12 provides greater circumferential contact area with the wellbore B. While in the illustrated apparatus 10, the rib portions 16 are curved, one or more of the rib portions 16 may alternatively have sloped end parts and a central part which is parallel or substantially parallel with the longitudinal axis X of the apparatus 10.

As shown in FIG. 1, the areas 22 between rib portions 16 are of constant or substantially constant wall thickness and are approximately matched to the outer body diameters of the mandrel 102 of the downhole tool 100 such that when located on the mandrel 102 the areas 22 are flush or substantially flush with the mandrel 102.

As well as functioning to facilitate fluid bypass around the outside of the apparatus 10, the areas 22 function as stretch zones facilitating the reconfiguration of the apparatus 10 between the first, second and third configurations.

The apparatus 10 provides a number of benefits over conventional tools and equipment. For example, in contrast to conventional tools the apparatus 10 obviates the requirement for split sleeve designs which add to complexity, cost and increased risk of failure downhole, and which require service breaks in order to install. The provision of the annular body portion 12 also obviates the requirement to provide associated clamps and threaded components to hold the split sleeves together. The provision of the annular body portion 12 and one or more ribs 16 integrally formed from a non-metallic material, in particular but not exclusively an elastomeric material such as HNBR, a thermoplastic material, such as PEEK or PTFE or a fibre reinforced polymer plastic, means that in the unlikely event of loss in the wellbore B, the apparatus or parts thereof are readily drillable; in contrast to conventional tools which require metallic components which cannot be easily drilled using conventional drill bits and so risk leaving "junk" in the wellbore B. Moreover, the relatively low coefficient of friction of the material used to form the integrally formed annular body portion 12 and rib portions 16 reduces both rotational and linear friction, amongst other things improving drilling efficiency, reducing casing wear and increasing the potential length of high angle or horizontal ERD wellbores. The relatively low density of the integrally formed annular body portion 12 and rib portions 16. As the density of the material used to form the integrally formed annular body portion 12 and the rib portions 16 is low compared to steel, any material loss from the apparatus 10, should it occur, can be readily circulated out of the wellbore B.

In the illustrated apparatus 10, an inner circumferential surface 24 of the annular body portion 12 forms a radial bearing surface between the apparatus 10 and the mandrel 102 of the downhole tool 100. End walls 26 of the annular body portion 12 form thrust bearing surfaces between the apparatus 10 and the body 102 of the downhole tool 100.

As shown in FIG. 1, the apparatus 10 comprises a fluid lubrication arrangement comprising flutes 28 and slots 30. The flutes 28 are formed in the inner circumferential surface 24 of the annular body portion 12. The slots 30 are formed in the end walls 26 of the annular body portion 12 and communicate with the flutes 28, so as to provide means for entry and exit of fluid into the flutes 28. In use, the flutes 28 and slots 30 receive fluid, in particular but not exclusively drilling fluid, so as to lubricate and cool the radial bearing surfaces formed by the inner circumferential surface 24 as the mandrel 102 rotates relative to the annular body portion 12 of the apparatus 10 and the thrust bearing surfaces formed by the end walls 26.

The annular body portion 12 and rib portions 16, which form the unitary construction, are constructed from an elastomeric material suitable for use in the downhole environment. In the illustrated apparatus 10, the annular body portion 12 is formed from hydrogenated nitrile rubber (HNBR). However, it will be understood that the annular body portion 12 may be constructed from other elastomeric materials, such as silicone rubber or other polymeric materials that have sufficient elastic modulus and/or wear resistance for use in the downhole environment.

Figure 2:
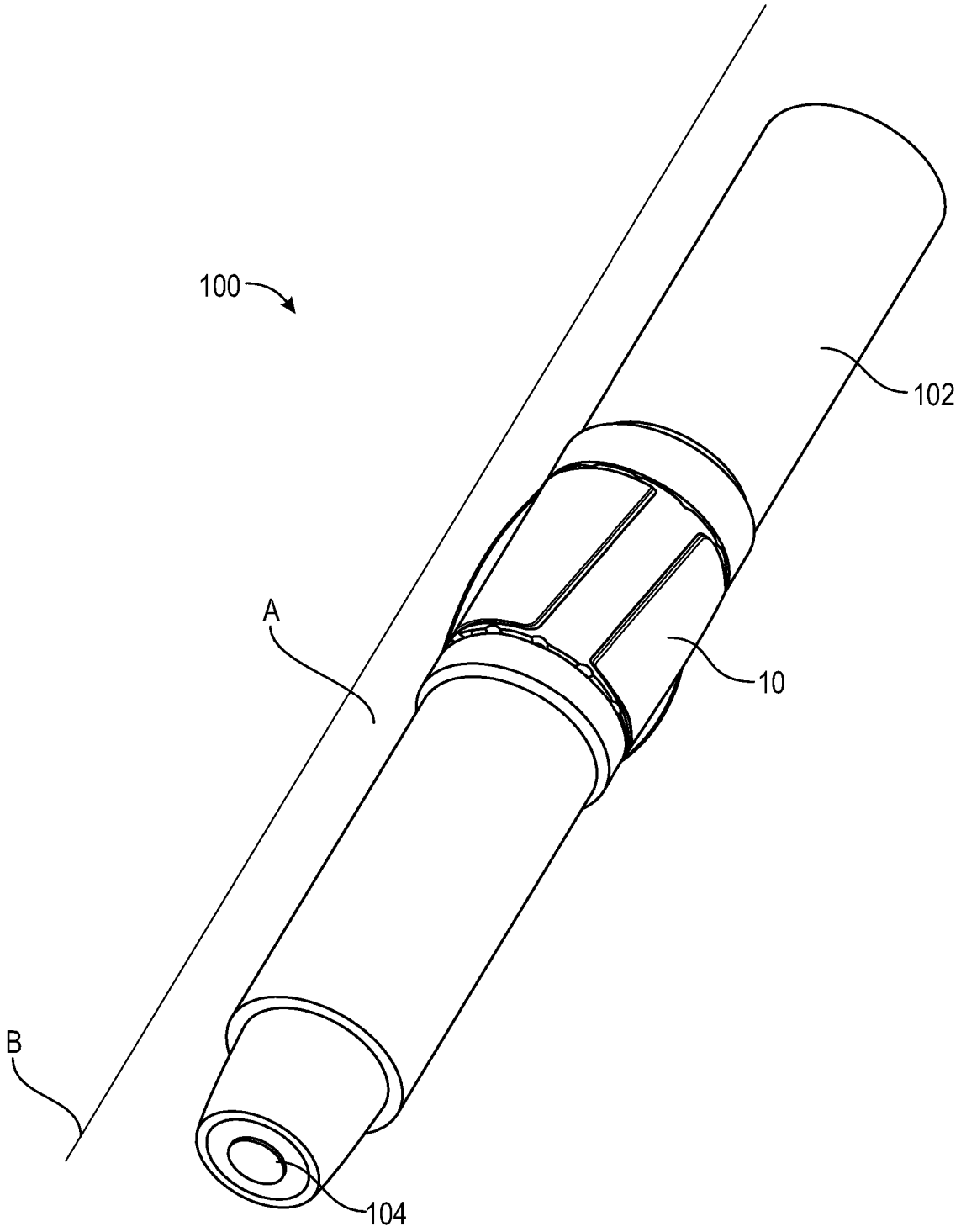
FIG. 2 shows a perspective view of a downhole tool comprising the downhole apparatus shown in FIG. 1.
Figure 3:
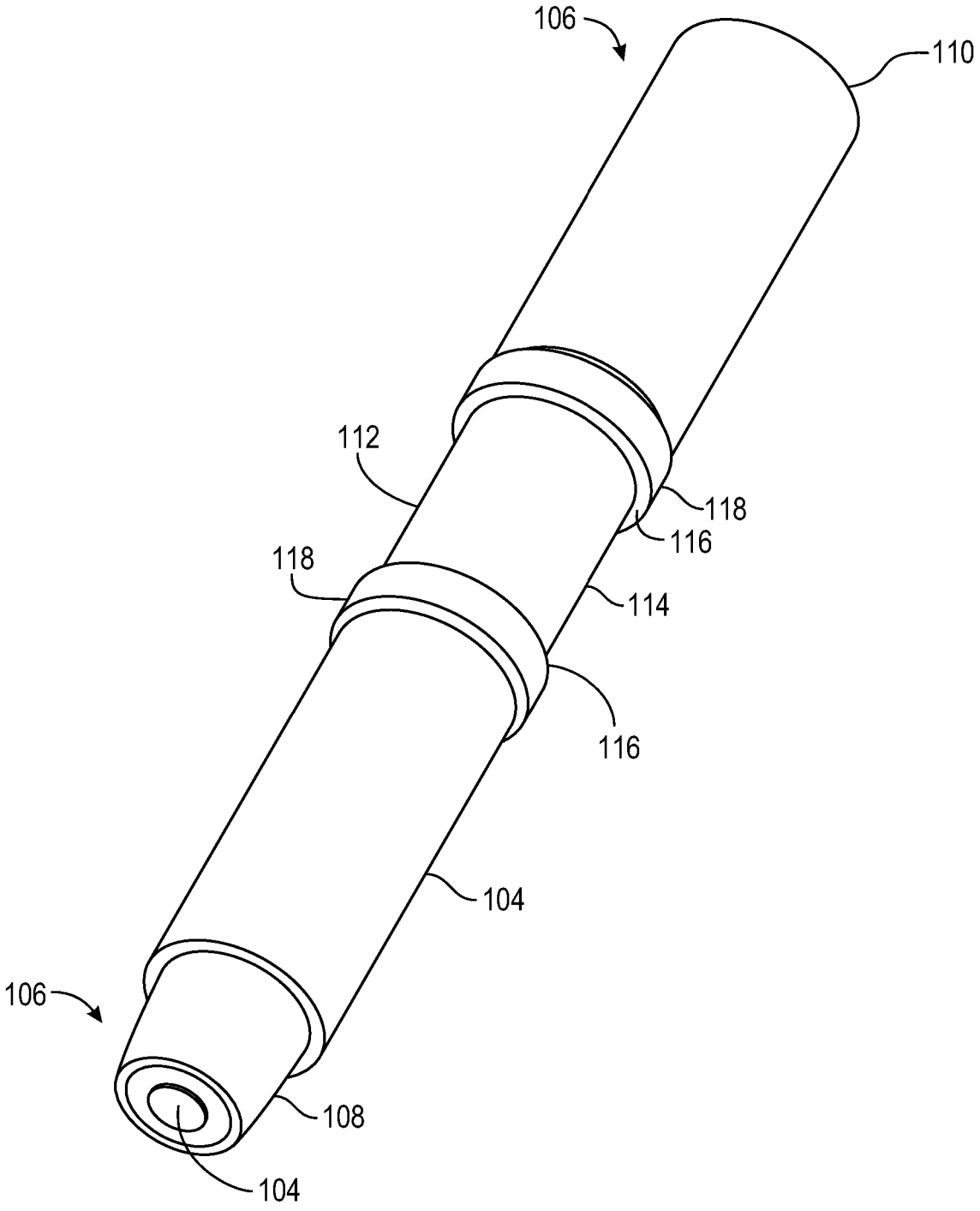
FIG. 3 shows a perspective view of a mandrel of the downhole tool shown in FIG. 2, with friction-reducing apparatus removed.

Referring now also to FIGS. 2 and 3 of the accompanying drawings, there is shown a downhole tool 100 comprising the apparatus 10. FIG. 2 shows the downhole tool 100 with the apparatus 10 located on the mandrel 102. FIG. 3 shows the mandrel 102 of the downhole tool 100 in isolation for ease of reference.

As shown in FIGS. 2 and 3, the mandrel 102 is generally tubular in construction having an axial throughbore 104 extending therethrough. The throughbore 104 facilitates the flow of drilling fluid and/or tools through the downhole tool 100. The mandrel 102 is constructed from thick wall tubing such as drill pipe or the like. The mandrel 102 takes the form of a sub and has a connection arrangement, generally denoted 106, to facilitate connection of the downhole tool 100 to adjacent components of downhole tool string 1000. In the illustrated apparatus, the connection arrangement 106 comprises a threaded pin connector 108 at a downhole end and threaded box connector 110 at an uphole end. The threaded pin and box connectors 108, 110 take the form of API (American Petroleum Institute) connectors. However, it will be understood that the connection arrangement 106 may alternatively comprise threaded pin connectors at both ends, threaded box connectors at both ends, a threaded pin connector at an uphole end and a threaded box connector at the downhole end. Alternatively, the connection arrangement 106 may take any other suitable form, such as premium connectors or the like.

As shown most clearly in FIG. 3 of the accompanying drawings, the mandrel 102 comprises a recess 112. The base 114 of the recess 112 defines a recessed bearing journal for the apparatus 10, while end faces 116 of the recess 112 define thrust bearing surfaces for the apparatus 10.

In the illustrated downhole tool 100, upsets 118 extend radially from the mandrel 102. The upsets 118 are disposed at respective ends of the recess 112 and provide an increased bearing area for the thrust bearing surfaces for a given size of tool and body design.

It will be understood, however, the mandrel 102 may alternatively define a cylindrical or substantially cylindrical outer surface without upsets. Beneficially, this provides a flush or substantially flush mandrel outer surface, which maximises the flow by area and minimises the effect on ECD (Equivalent Circulating Density) when running large numbers of the downhole tools in the wellbore B simultaneously.

An assembly and method for construction of the downhole tool 100 will now be described with reference to FIGS. 4 to 7 of the accompanying drawings.

Figure 4:
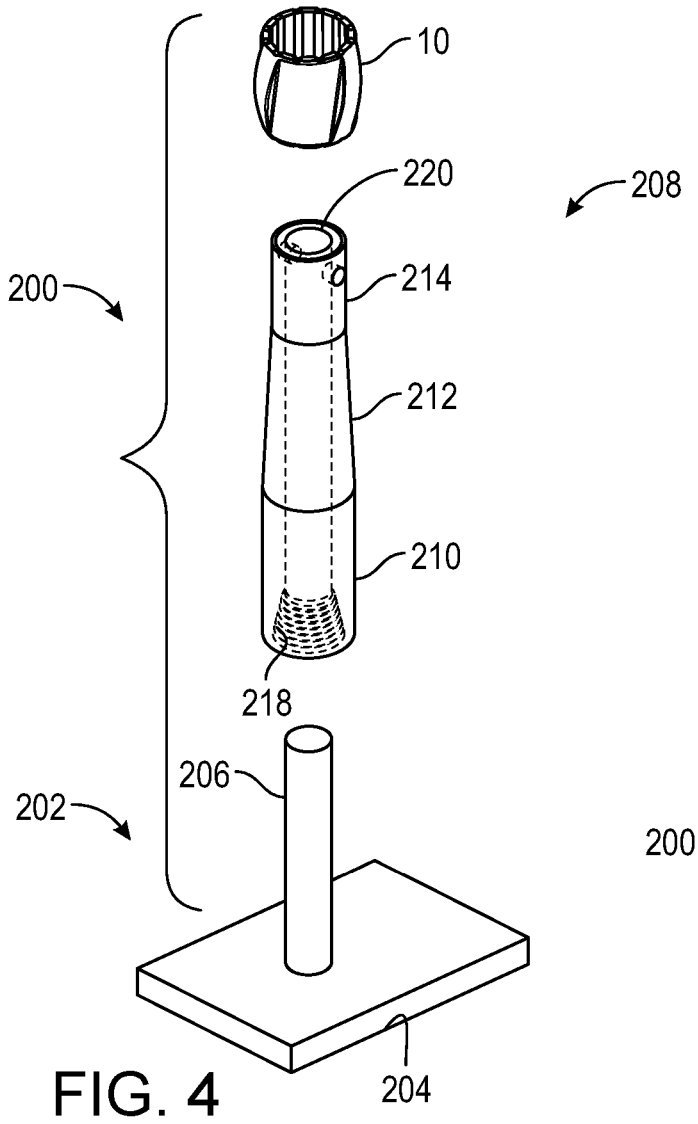
FIG. 4 shows an exploded view of an assembly jig for constructing the downhole tool shown in FIG. 2.
Figure 5:
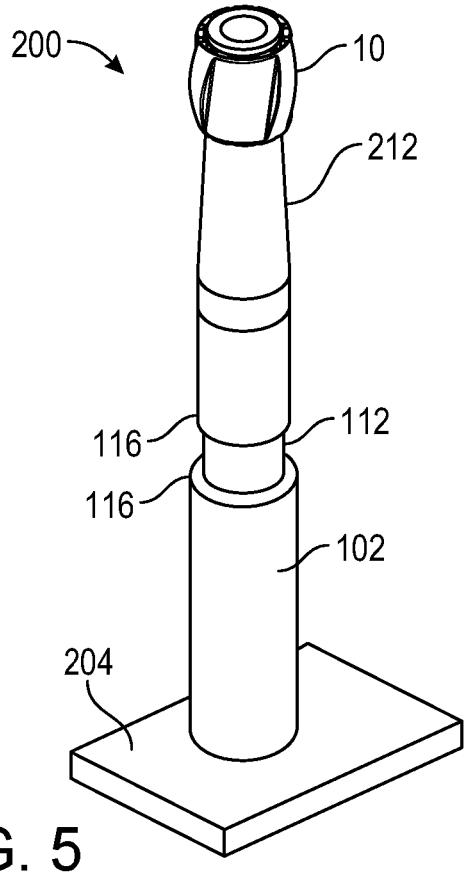
FIG. 5 shows the downhole tool located on the assembly jig shown in FIG. 4.

Referring first to FIGS. 4 and 5 of the accompanying drawings, an assembly jig, generally denoted 200, is provided. As shown in FIG. 4, the assembly jig 200 comprises a spigot assembly 202 including a base portion 204 and a spigot portion 206. The assembly jig 200 further comprises an expander tool in the form of a forcing cone 208.

Figure 6:
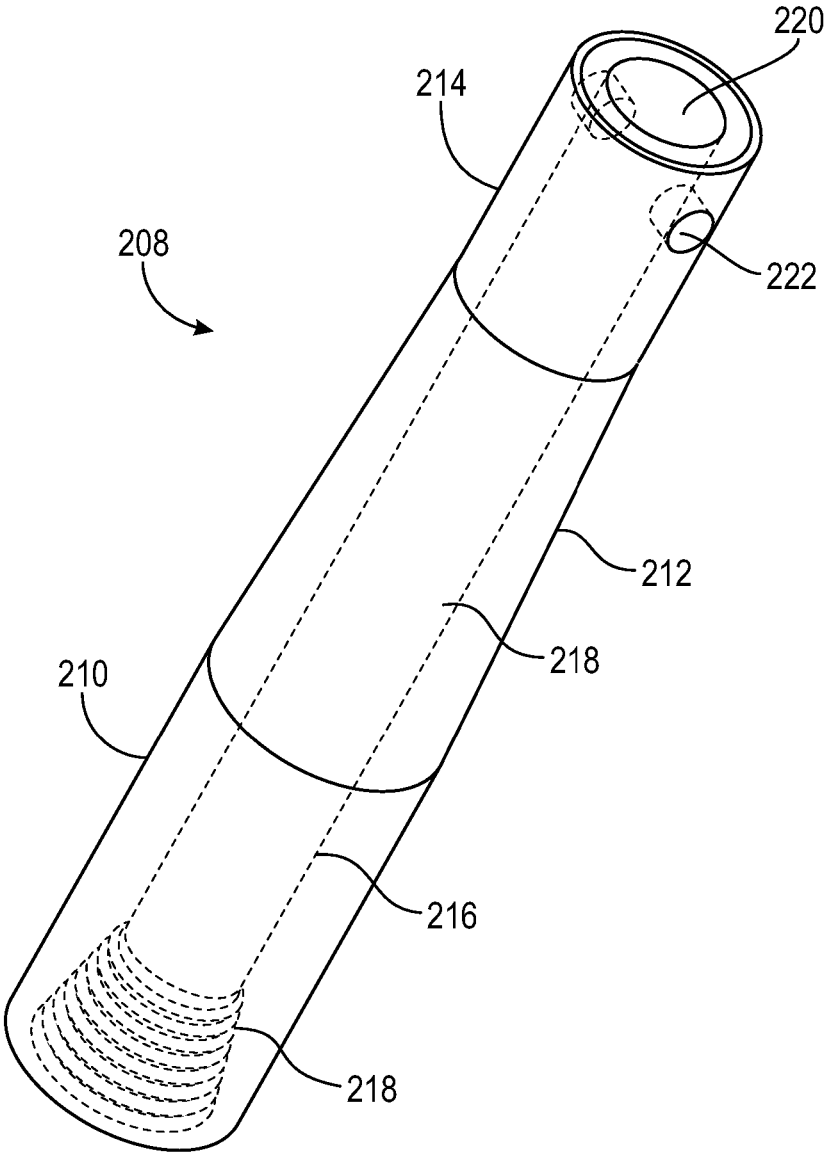
FIG. 6 shows a perspective view of an expander tool of the assembly jig shown in FIGS. 4 and 5.

As shown most clearly in FIG. 6, which shows an enlarged view of the forcing cone 208, the forcing cone 208 comprises a first portion 210, a second portion 212 and a third portion 214.

The first portion 210 is generally tubular in shape, having a throughbore 216. An end portion 218 (the lower end portion as shown in FIG. 5) of the throughbore 216 defines a female portion formed with a thread and/or enlarged bore to facilitate the coupling of the forcing cone 208 to the threaded pin connector 108 of the mandrel 102 as described further below. In the illustrated jig 200, the thread and/or enlarged bore is machined, although the thread and/or enlarged bore may alternatively be formed by any suitable process.

The second portion 212 of the forcing cone 208 is interposed between the first portion 210 and the third portion 214. As with the first portion 210, the second portion 212 has a throughbore 218. However, the second portion 212 is generally frusto-conical in shape. The second portion 212 facilitates the expansion of the apparatus 10 to the second configuration as will be described further below.

The third portion 214 is generally tubular in shape, having a throughbore 220. The outer diameter of the third portion 214 matches or is slightly greater in diameter than the outside diameter of the mandrel 102. The third portion 214 comprises cross drilled bores 222, which in the illustrated jig 200 is formed—in particular but not exclusively machined, at 90 degrees to the throughbore 220. The bores 222 facilitate the handling of the forcing cone 208 as will be described further below.

In use, the method of construction comprises locating the forcing cone 208 on the mandrel 102 of the downhole tool 100, and making up the connection between the threaded pin connector 108 of the mandrel 102 and the end portion 218 of the first portion 210 of the forcing cone 208. Once secured, the forcing cone 208 and mandrel 102 form an assembly which can be handled via the bores 222 using a lifting device 224 (shown in FIG. 7).

The forcing cone 208 and mandrel 102 are placed on the spigot portion 206 of the assembly jig 200.

The apparatus 10 in its first configuration is then located on the third portion 214 of the forcing cone 208. In the illustrated assembly jig 200, the forcing cone coated in a grease oil or a soap solution to ease the expansion of the apparatus 10 from its first configuration to its second configuration.

Figure 7:
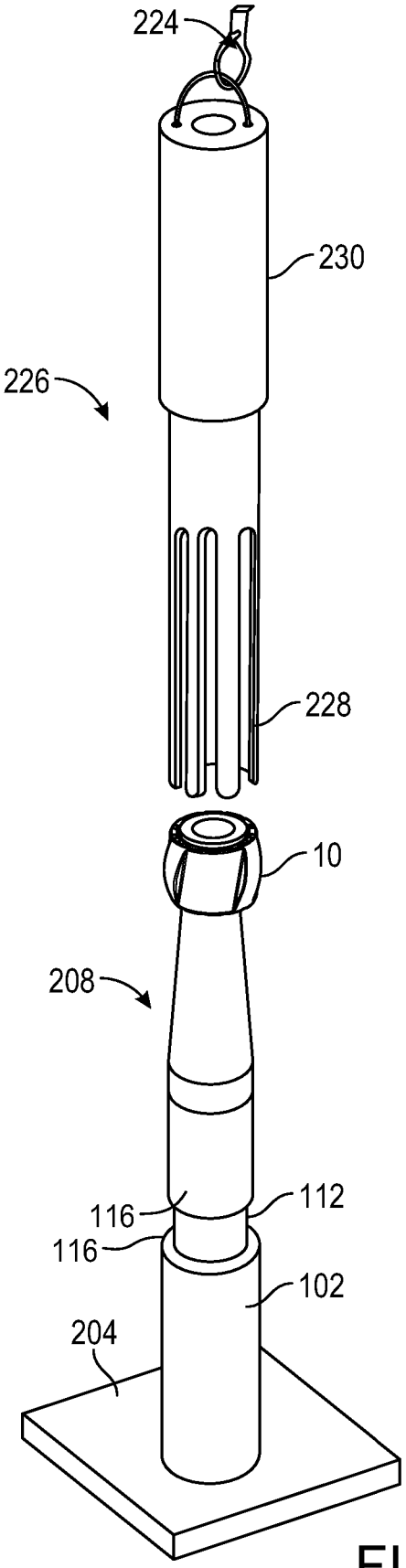
FIG. 7 shows a pushing tool of the assembly jig.

Referring now to FIG. 7 of the accompanying drawings, the assembly jig 200 further comprises a pushing tool 226. In the illustrated jig 200, the pushing tool 226 takes the form of a collet fingered pushing tool having a number of circumferentially arranged collet fingers 228, a mass 230 and a handle 232 to facilitate handling of the pushing tool 226 by the lifting device 224.

In use, the pushing tool 226 is manipulated into position above the forcing cone 208 and lowered into engagement with the apparatus 10, the weight force of the mass 230 urging the collet fingers 228 to translate the apparatus 10 along the forcing cone 208. As the apparatus 10 is translated up the frusto-conical second portion 212 of the forcing cone 208, the apparatus 10 is expanded from its first configuration to its second configuration of greater inner diameter than the first configuration.

As the forcing cone 208 is coupled to the mandrel 102, the pushing tool 226 translates the apparatus 10, now in its second, larger diameter, configuration, along the mandrel 102 and into the recess 112, as shown in FIG. 2.

On location on the recess 112, the apparatus 10 elastically recovers, contracting to its third configuration, the third configuration being the same or similar to that of the first configuration the apparatus 10 defined before being elastically expanded.

The throughbore 14 and the length of the annular body portion 12 of the apparatus 10 are configured so that in the third configuration the apparatus 10 has sufficient diametric and end float clearance to run effectively as a mud lubricated bearing.

It will be understood that various modifications may be made without departing from the scope of the invention as defined in the claims.

Figure 8:
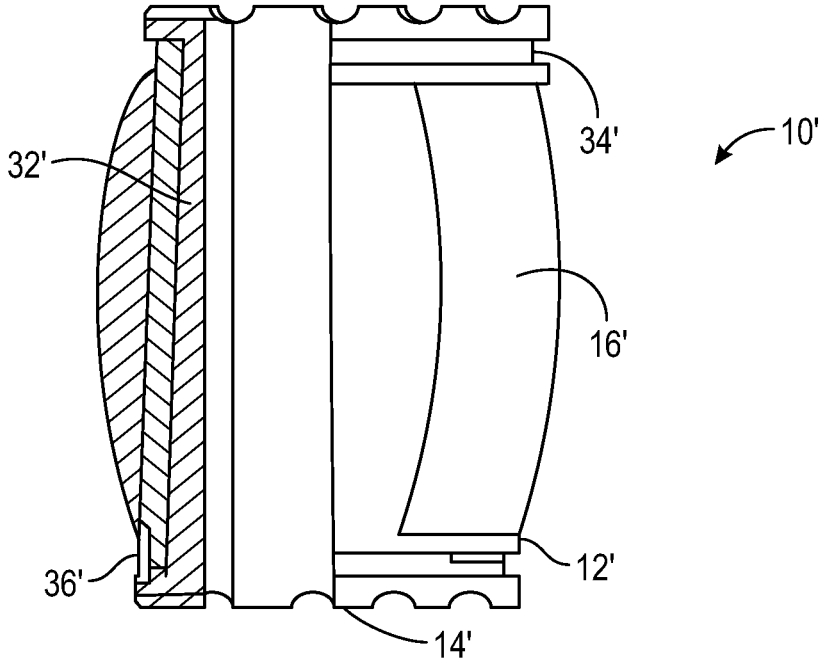
FIG. 8 shows a part-sectional view of an alternative downhole apparatus for reducing friction between a downhole tool and/or downhole tool string and the wall of a wellbore

For example, referring now to FIG. 8 of the accompanying drawings, there is shown an alternative apparatus 10' for reducing friction between a downhole tool 100' and/or downhole tool string and the wall of a well borehole ("wellbore B"). The apparatus 10' is similar to the apparatus 10 and like components are represented by like reference signs.

In use, the downhole apparatus 10' takes the form of a bearing sleeve configured for location on a body or mandrel 102' of the downhole tool 100', the apparatus 10' functioning to reduce friction between the downhole tool 100 and the wall of the wellbore B. The downhole tool 100' forms part of a downhole tool string, the apparatus 10' and downhole tool 100' functioning to reduce friction between the downhole tool string and the wall of the wellbore B during ingress into and/or egress out of the wellbore B. In particular, but not exclusively, the downhole tool string may take the form of a drill string used to drill the wellbore B, but may alternatively take the form of a completion string, work string or the like. It will be understood that in the context of the present disclosure the term wellbore B is used to mean either or both of a cased section of the wellbore B or open hole section of the wellbore B.

As shown in FIG. 8, like the apparatus 10, the apparatus 10' comprises an annular body portion 12' which is generally tubular in construction, the body portion 12' defining an axial throughbore 14' which facilitates location of the body portion 12' on the mandrel 102' of the downhole tool 100'.

A plurality of rib portions 16' extend radially from the annular body portion 12'. In use, the rib portions 16' form blades which offset the downhole tool 100' from the wellbore B and facilitate fluid bypass around the outside of the annular body portion 12' in the annulus A between the apparatus 10' and the wellbore B. The body portion 12' and the rib portions 16' are integrally formed as a single piece construction.

While the downhole tool 100 provides a robust and simple tool, fit for use in downhole oilfield conditions, the apparatus 10' a secondary security and failsafe arrangement as will be described below.

In the apparatus 10', the annular body portion 12' comprises one or more stiffening or reinforcing members 32' moulded therein. While in the illustrated apparatus 10', the reinforcing members 32' are moulded within the annular body portion 12, one or more of the reinforcing members 32' may alternatively be applied onto the annular body portion 12'.

In the illustrated apparatus 10', the one or more stiffening or reinforcing members 32' take the form of resin fibre composite bars. However, it will be understood that the stiffening or reinforcing members 32' may take other suitable forms and may be constructed from other suitable materials such as carbon fibre reinforced composite or basalt fibre reinforce composite.

In use, the reinforcing members 32' prevent or at least mitigate the possibility of compressive buckling of the apparatus 10' and/or swelling when being pulled through a wellbore B restriction.

As shown in FIG. 8, the annular body portion 12' of the apparatus 10' comprises recessed grooves 34' for receiving locking bands 36'. In the illustrated apparatus 10', the recessed grooves 34' are formed into the top and bottom sections of the annular body portion 12' at the moulding stage.

The locking bands 36' are formed from a composite material. In the illustrated apparatus 10' the locking bands 36' are formed from a fibre reinforced composite including aramid fibres such as Kevlar. However, it will be understood that the locking bands 36' may alternatively be formed from other suitable materials, such as a fibre reinforced composite including carbon fibres or other high strength fibre. The locking bands 36' are bonded in place by a flexible elastomeric silicone, rubber or epoxy based resin or compound.

Figure 9:
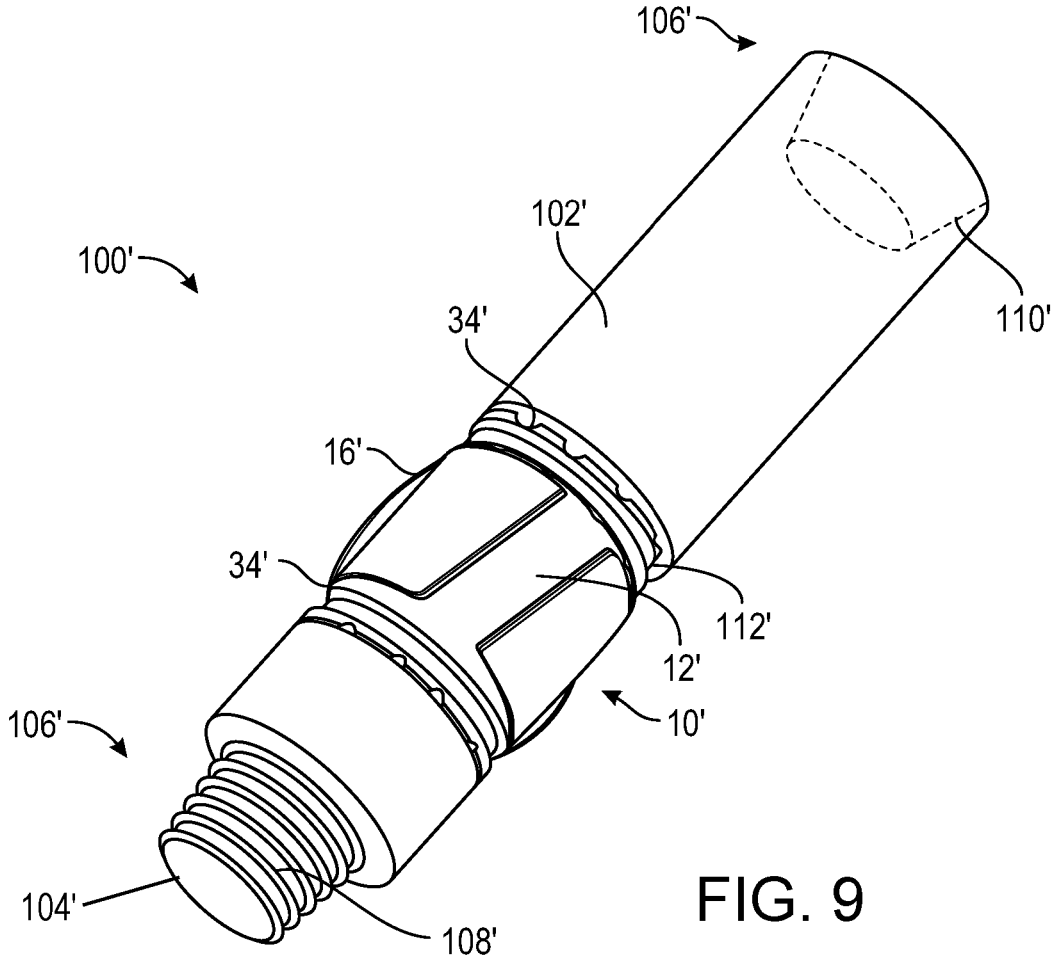
FIG. 9 shows a perspective view of a downhole tool comprising the downhole apparatus shown in FIG. 8.
Figure 10:
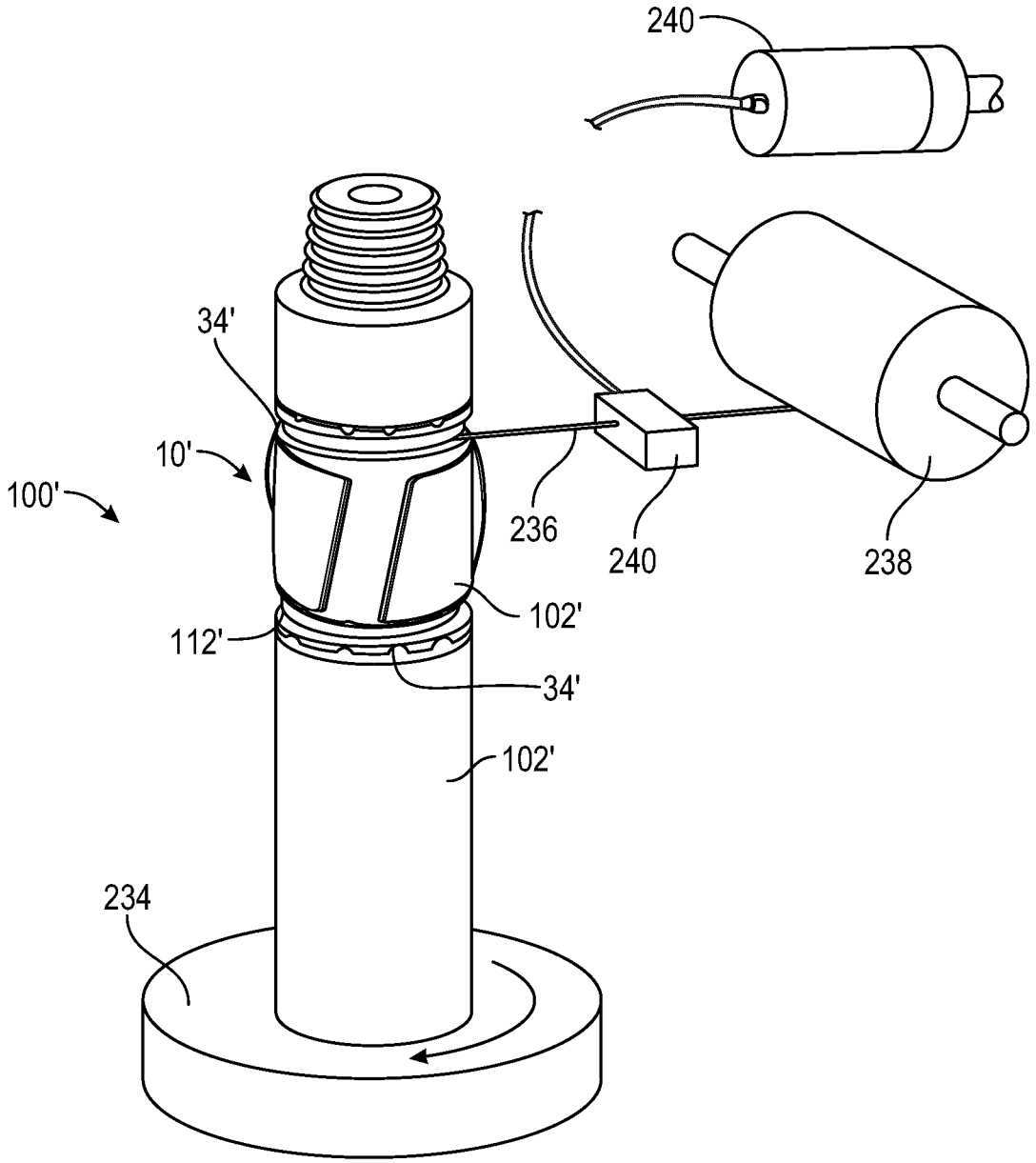
FIG. 10 shows an arrangement for locating reinforcement members on the friction-reducing apparatus of the downhole tool shown in FIG. 9.

Referring now also to FIG. 9 of the accompanying drawings, there is shown a downhole 100' comprising the apparatus 10'. FIG. 9 shows the downhole tool 100' with the apparatus 10' located on the mandrel 102'. FIG. 10 shows the mandrel 102' of the downhole tool 100' in isolation for ease of reference.

The mandrel 102' is generally tubular in construction having an axial throughbore 104' extending therethrough. The throughbore 104' facilitates the flow of drilling fluid and/or tools through the downhole tool 100'. The mandrel 102' is constructed from thick wall tubing such as drill pipe or the like. The mandrel 102' takes the form of a sub and has a connection arrangement, generally denoted 106', to facilitate connection of the downhole tool 100' to adjacent components of downhole tool string 1000. In the illustrated downhole tool 100', the connection arrangement 106' comprises a threaded pin connector 108' at a downhole end and threaded box connector 110' (shown in hidden line) at an uphole end. The threaded pin and box connectors 108', 110' take the form of API (American Petroleum Institute) connectors. However, it will be understood that the connection arrangement 106' may alternatively comprise threaded pin connectors at both ends, threaded box connectors at both ends, a threaded pin connector at an uphole end and a threaded box connector at the downhole end. Alternatively, the connection arrangement 106' may take any other suitable form, such as premium connectors or the like.

The mandrel 102' comprises a recess 112'. Although not shown, the base of the recess 112' defines a recessed bearing journal for the apparatus 10', while end faces of the recess 112 define thrust bearing surfaces for the apparatus 10' in a similar manner to that shown and described above with respect to the apparatus 10.

An assembly and method for construction of the downhole tool 100' will now be described with reference to FIG. 10 of the accompanying drawings.

As shown in FIG. 10, the downhole tool 100' is located on a rotary base 234, the rotary base 234 providing a means of rotating the tool 100' for the purpose of winding the precoated aramid fibre, e.g. Kevlar, yarn 236 from a reel or bobbin 238 via a resin or elastomer coating system 240 into the preformed recessed grooves 34' to form the composite locking band 36'. It will be understood that this operation could alternatively be achieved with the use of a purpose built winding head or horizontally on a lathe or other similar rotating system. Where provided, the reinforcing members 32' may be further locked in position by the application of the reinforcing members 32'.

As described above, various modifications may be made without departing from the scope of the invention as defined in the claims.

For example, while the assembly method described above is a mass based pushing system, it could also be achieved vertically or horizontally by means of hydraulic ram type pushing systems.

It should be noted that more than one apparatus per body could also be mounted in the same way and that these apparatus, though concentric to the axis of the mandrel may also be mounted in to recessed bearing journal or journals which may be offset and/or skewed with respect to the longitudinal axis of the mandrel 102.

As described above, the downhole tool may form part of a downhole tool string, the downhole tool functioning to reduce friction between the downhole tool string and the wall of the wellbore during ingress into and/or egress out of the wellbore. In particular, but not exclusively, the downhole tool string may take the form of a drill string used to drill the wellbore, but may alternatively take the form of a completion string, work string or the like. It will be understood that in the context of the present disclosure the term wellbore is used to mean either or both of a cased section of the wellbore or open hole section of the wellbore.

Figure 11:
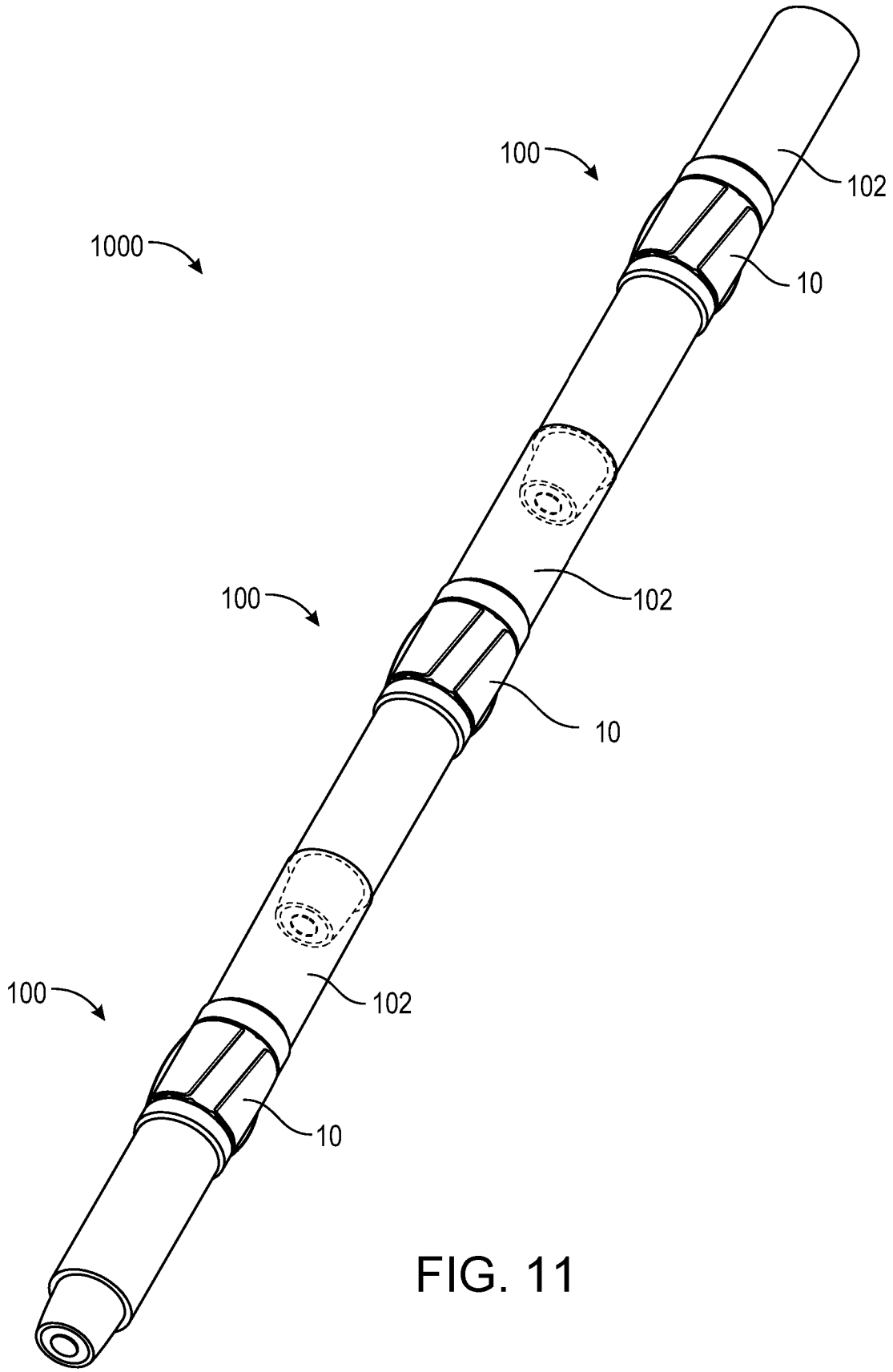
FIG. 11 shows a tool string comprising a plurality of the downhole tools shown in FIG. 2.

FIG. 11 shows a downhole tool string 1000 comprising a plurality of the downhole tools 100 shown in FIG. 2. While the illustrated downhole tool string 1000 comprises a number of the downhole tools 100, it will e recognised that the downhole tool string 1000 may alternatively or additionally comprise one or more of the downhole tools 100'.

The invention claimed is:

1. A downhole apparatus for reducing rotational and linear friction between a downhole tool and/or a downhole tool string comprising said downhole tool and a wall of a wellbore, the downhole apparatus comprising:

an annular body portion configured for location on a mandrel of the downhole tool;

one or more rib portions extending radially from the annular body portion, and configured to engage the wall of the wellbore;

wherein the annular body portion and the one or more rib portions are integrally formed from a non-metallic material;

wherein the annular body portion has a first inner diameter smaller than a maximum outer diameter of the mandrel;

wherein the annular body portion is elastically reconfigurable between a first configuration in which the annular body portion defines said first inner diameter and a second configuration in which the annular body portion defines a second inner diameter, the second inner diameter being larger than the first inner diameter so as to permit location of the apparatus around and along the mandrel; and and wherein the annular body portion is elastically reconfigurable between the second configuration and a third configuration in which the annular body portion defines a third inner diameter, the third inner diameter being smaller than the second inner diameter and larger than a minimum outer diameter of the mandrel so as to permit the apparatus to be located on the mandrel such that the mandrel is rotatable within the apparatus and/or the apparatus is rotatable around the mandrel.

2. The apparatus of claim 1, wherein the annular body portion is tubular in construction, the annular body portion defining an axial throughbore.

3. The apparatus of claim 1, wherein the one or more rib portions comprises a plurality of rib portions.

4. The apparatus of claim 1, wherein an inner circumferential surface of the annular body portion defines a radial bearing surface.

5. The apparatus of claim 1, further comprising a fluid lubrication arrangement, comprising:

one or more flutes formed in an inner circumferential surface of the annular body portion;

one or more slots formed in the end walls of the annular body portion, wherein the one or more slots communicates with the one or more flutes so as to provide means for entry and exit of fluid into the one or more flutes.

6. The apparatus of claim 1, comprising a reinforcing arrangement, the reinforcing arrangement comprising at least one of:

one or more reinforcing members;

one or more locking bands.

7. The apparatus of claim 6, wherein the one or more reinforcing members are formed in or applied onto the annular body portion.

8. The apparatus of claim 6, wherein the one or more reinforcing members are constructed from a resin fibre composite material.

9. The apparatus of claim 6, wherein the one or more locking bands are configured for location in respective recessed grooves of the one or more recessed grooves formed in the annular body portion.

10. The apparatus of claim 6, wherein the one or more locking bands are formed from a composite material.

11. The apparatus of claim 1, wherein the annular body portion and the one or more rib portions are formed from an elastomeric material.

12. The apparatus of claim 11, wherein the annular body portion and the one or more rib portions are formed from silicone rubber or hydrogenated nitrile butadiene rubber (HNBR).

13. The apparatus of claim 1, wherein the annular body portion and the one or more rib portions are formed from a thermoplastic material.

14. The apparatus of claim 13, wherein the annular body portion and the one or more rib portions are formed from polyetheretherketone (PEEK) or polytetrafluoroethylene (PTFE).

15. The apparatus of claim 1, wherein the annular body portion and the one or more ribs are formed from a fibre reinforced polymer plastic.

16. The apparatus of claim 1, wherein at least one end wall of the annular body portion defines a thrust bearing surface.

17. The apparatus of claim 1, wherein the third inner diameter is the same or substantially the same as the first inner diameter.

18. The apparatus of claim 10, wherein the one or more locking bands are formed from a fibre reinforced composite.

19. The apparatus of claim 18, wherein the one or more locking bands are formed from a fibre reinforced composite including aramid fibres or a fibre reinforced composite including carbon fibres.

20. A downhole tool comprising:

a mandrel; and one or more downhole apparatus' for reducing rotational and linear friction between said downhole tool and/or a downhole tool string comprising said downhole tool and a wall of a wellbore, each downhole apparatus comprising:

an annular body portion configured for location on the mandrel of the downhole tool;

one or more rib portions extending radially from the annular body portion, and configured to engage the wall of the wellbore, wherein the annular body portion and the one or more rib portions are integrally formed from a non-metallic material, wherein the annular body portion has a first inner diameter smaller than a maximum outer diameter of the mandrel, wherein the annular body portion is elastically reconfigurable between a first configuration in which the annular body portion defines said first inner diameter and a second configuration in which the annular body portion defines a second inner diameter, the second inner diameter being larger than the first inner diameter so as to permit location of the apparatus around and along the mandrel, and wherein the annular body portion is elastically reconfigurable between the second configuration and a third configuration in which the annular body portion defines a third inner diameter, the third inner diameter being smaller than the second inner diameter and larger than a minimum outer diameter of the mandrel so as to permit the apparatus to be located on the mandrel such that the mandrel is rotatable within the apparatus and/or the apparatus is rotatable around the mandrel.

21. The downhole tool of claim 20, wherein one or more upsets extend radially from the mandrel.

22. The downhole tool of claim 20, wherein the mandrel comprises a recess configured to receive the downhole apparatus, a base of the recess defining a bearing journal for the apparatus.

23. The downhole tool of claim 22, wherein one or more end faces of the recess define thrust bearing surfaces for the apparatus.

24. The downhole tool of claim 20, wherein at least one of:

the apparatus is mountable on the mandrel so as to define a skew angle relative to a central longitudinal axis of the mandrel; and/or the apparatus is mountable on the mandrel so that the apparatus is offset from the central longitudinal axis of the mandrel.

25. A downhole tool string comprising one or more downhole tools, each of said one or more downhole tools comprising:

a mandrel; and one or more downhole apparatus' for reducing rotational and linear friction between said downhole tool and/or a downhole tool string comprising said downhole tool and a wall of a wellbore, each downhole apparatus comprising:

an annular body portion configured for location on the mandrel of the downhole tool;

one or more rib portions extending radially from the annular body portion, and configured to engage the wall of the wellbore, wherein the annular body portion and the one or more rib portions are integrally formed from a non-metallic material, wherein the annular body portion has a first inner diameter smaller than a maximum outer diameter of the mandrel, wherein the annular body portion is elastically reconfigurable between a first configuration in which the annular body portion defines said first inner diameter and a second configuration in which the annular body portion defines a second inner diameter, the second inner diameter being larger than the first inner diameter so as to permit location of the apparatus around and along the mandrel, and wherein the annular body portion is elastically reconfigurable between the second configuration and a third configuration in which the annular body portion defines a third inner diameter, the third inner diameter being smaller than the second inner diameter and larger than a minimum outer diameter of the mandrel so as to permit the apparatus to be located on the mandrel such that the mandrel is rotatable within the apparatus and/or the apparatus is rotatable around the mandrel.

26. A method of reducing rotational and linear friction between a downhole tool and/or a downhole tool string comprising said downhole tool and a wall of the wellbore, the method comprising:

running one or more downhole tools into the wellbore, each of said one or more downhole tools comprising:

a mandrel; and one or more downhole apparatus' comprising:

an annular body portion configured for location on the mandrel of the downhole tool;

one or more rib portions extending radially from the annular body portion, and configured to engage the wall of the wellbore, wherein the annular body portion and the one or more rib portions are integrally formed from a non-metallic material, wherein the annular body portion has a first inner diameter smaller than a maximum outer diameter of the mandrel, wherein the annular body portion is elastically reconfigurable between a first configuration in which the annular body portion defines said first inner diameter and a second configuration in which the annular body portion defines a second inner diameter, the second inner diameter being larger than the first inner diameter so as to permit location of the apparatus around and along the mandrel, and wherein the annular body portion is elastically reconfigurable between the second configuration and a third configuration in which the annular body portion defines a third inner diameter, the third inner diameter being smaller than the second inner diameter and larger than a minimum outer diameter of the mandrel so as to permit the apparatus to be located on the mandrel such that the mandrel is rotatable within the apparatus and/or the apparatus is rotatable around the mandrel.

27. A method of construction of the downhole tool of claim 20, comprising:

using an expander tool to elastically reconfigure the downhole apparatus from the first configuration;

translating the downhole apparatus along the mandrel of the downhole tool in the second configuration; and elastically reconfiguring the annular body portion of the apparatus from the second configuration to the third configuration.

* * * * *